US005147977A

United States Patent [19]

Reichert

[11] Patent Number: 5,147,977

[45] Date of Patent: Sep. 15, 1992

[54] DEVICE FOR THE DETECTION OF OBJECTS AND THE RELEASE OF FIRING FOR GROUND-TO-AIR MINES TO BE FIRED IN THE HELICOPTER COMBAT

[75] Inventor: Curt Reichert, Heimbach, Fed. Rep. of Germany

[73] Assignee: SenSys AG, Im Ziel, Switzerland

[21] Appl. No.: 569,185

[22] Filed: Aug. 17, 1990

[30] Foreign Application Priority Data

Aug. 22, 1989 [DE] Fed. Rep. of Germany ..... 3927663

[51] Int. Cl.[5] ..... F42C 13/06

[52] U.S. Cl. ..... 102/427; 102/211

[58] Field of Search ..... 102/211, 213, 401, 404, 102/405, 427; 89/1.11

[56] References Cited

U.S. PATENT DOCUMENTS

| | | | |
|---|---|---|---|
| 3,509,791 | 5/1970 | Pechamat et al. | 102/427 |
| 3,614,723 | 10/1971 | Hermes et al. . | |
| 3,902,172 | 8/1975 | Weiss et al. . | |
| 4,712,479 | 12/1987 | Babel | 102/427 |
| 4,919,051 | 4/1990 | Cohen | 102/404 |

FOREIGN PATENT DOCUMENTS

| | | | |
|---|---|---|---|
| 3326748 | 2/1985 | Fed. Rep. of Germany | 102/404 |
| 3837483 | 5/1990 | Fed. Rep. of Germany | 102/427 |
| 2541444 | 8/1984 | France | 102/427 |
| 2108246 | 5/1983 | United Kingdom . | |

*Primary Examiner*—Harold J. Tudor

*Attorney, Agent, or Firm*—Marmorek, Guttman & Rubenstein

[57] ABSTRACT

A helicopter combat device for detecting flying objects and for causing a ground-to-air mine to be fired at them, comprises a microphone which is sensitive to noise generated by a helicopter, an infrared sensor having a directional characteristic which is within the firing cone of the ground-to-air mine, and an electronic evaluation unit which receives and processes electrical signals generated by the microphone and the infrared sensor. The electronic evaluation unit separates the electrical signals received from the microphone into a first band corresponding to noise having a frequency in the range of 5–40 Hz (typical of a rotating rotor of a helicopter), and a second band corresponding to noise having a frequency in the range of 200–1000 Hz (typical of the machine noise of a helicopter). If the electronic evaluation unit detects the presence of electrical signals from the first and second bands and electric signals from the infrared sensor above predetermined threshold levels, it will cause the ground-to-air mine to fire.

5 Claims, 4 Drawing Sheets

DEVICE FOR THE DETECTION OF OBJECTS AND THE RELEASE OF FIRING FOR GROUND-TO-AIR MINES TO BE FIRED IN THE HELICOPTER COMBAT

BACKGROUND OF THE INVENTION

The present invention is directed to a device for detecting flying objects and for firing ground-to-air mines at them. The device is especially useful in helicopter combat. By "ground-to-air mine" is meant a defensive mine which is fired from the ground against a flying object, for instance, against a helicopter.

The invention is based on the object to provide a device for detecting flying objects and for firing such a ground-to-air mine which is characterized by especially high simplicity and functional safety, as well as low consumption of energy.

SUMMARY OF THE INVENTION

According to the invention this object is achieved by a device installed on a ground-to-air mine which is comprised of the following components:

- a microphone which is sensitive to helicopter noise,
- an infrared sensor which is adjusted with its directional characteristic to the scattering range of the ground-to-air mine, i.e., to the scattering cone in which the ground-to-air mine is fired, and
- electronic evaluation means which analyzes the helicopter noise and causes firing of the ground-to-air mine when the helicopter noise is above a predetermined intensity level and the infrared sensor simultaneously detects the presence of an object within its directional characteristic.

The inventive device combines the advantages of a mine, which is autonomous and which can be inconspicuously placed, with modern electronics and sensory equipment, and consequently allows utilization of this mine in a third dimension, i.e., against flying targets. A ground-to-air mine equipped with the inventive device is fixedly emplaced. A follow-up is not required. Accordingly, several mines should be emplaced adjacent to one another and aimed in different firing directions in order to cover a predetermined section of air space. The density of the emplacements and the scattering ranges of the missiles are decisive for an effective mine belt functioning against a target flying in the third dimension.

The inventive device can be implemented with a single microphone. In a first phase, the noise received by the microphone is analyzed for characteristics which are typical for helicopters. According to the invention, acoustic locating need not be carried out, but rather acoustic detection is all that is required. Once acoustic detection occurs a second phase in which the infrared sensor and the corresponding electronics are switched on and in which also the third phase, namely firing of the ground-to-air mine, takes place.

According to an improvement of the invention, the electronic evaluation means separates the signals received from the microphone and/or the infrared sensor into different bands, evaluates the bands separately, feeds the same to a comparator, and then feeds the signals to a logical element (combinatorial circuit). According to a special embodiment, the electronic evaluation means separates the noise signals received by the microphone into a band having a frequency of 5–40 Hz and a band having a frequency within the range of 200–1000 Hz. The first band corresponds to a sound frequency range (infrasonic) which is characteristic of a rotating rotor of a helicopter, while the second band is characteristic of the machine noise of a helicopter. Only if signals in both frequency ranges are present and the infrared sensor also reacts, is the mine fired. In other words, according to the invention, the evaluation electronics carries out a division of the noise signal into several ranges and the mine is activated only if the received signal falls into those frequency ranges which are characteristic for helicopters. For example, the above-mentioned frequency range of 5–40 Hz representing the noise generated by the rotation of the rotor is very characteristic of helicopters.

False releases are largely avoided by the above-mentioned division into a plurality of frequency ranges and the following logical combining of the signals. In this manner, the number of criteria is increased which have to be fulfilled for activation of the mine. Accordingly, each criterion has to be met before the mine is activated.

As regards the design of the infrared sensor, according to an embodiment of the invention, the infrared sensor has a beam-like "directional club" in the direction in which the ground-to-air mine is to be fired. The term "directional club" specifies the reception characteristic of an infrared sensor or of an aggregate comprising a plurality of infrared sensors. In the functional range of the inventive device, it is more or less club-like. The sensitivity increases towards the axis.

The infrared sensor has to have a directional characteristic which guarantees a suitable release behavior of the ground-to-air mine. However, at a larger height, the helicopter or the infrared source (turbine) thereof appears quite small with respect to the scattering cone in which the mine is fired. Accordingly, an infrared detector whose sensitivity is directly adjusted to the scattering cone of the mine supplies only a relatively weak infrared signal. Consequently, a certain susceptibility with regard to disturbances (for instance, passing clouds) cannot be excluded. Furthermore, it is technically expensive to achieve a sharp limitation of such a great field of view. A sharp limitation is necessary in order to guarantee a release performance independent of the helicopter velocity in broad limits.

In order to remove these disadvantages of the above-described embodiment of the invention, a further alternative is proposed according to which the infrared sensor has a sensitivity distribution comprising an active cone having a plurality of zones of maximum sensitivity located within the active cone. Such a sensitivity distribution of the infrared sensor can be achieved without any problems by segmented infrared lenses or mirrors. When the helicopter flies through one of the sensitized zones, a very significant signal results, and the sensitivity with respect to disturbances is decreased.

As regards the microphone which is used according to the invention, the same must be sensitive to helicopter noise, especially to noise in the infrasonic range (generated by the rotation of the rotor). Such a microphone need not have any special directional characteristic. However, for the inventive device one can also use a directional microphone with a conical acoustic directional characteristic which defines a target range. Preferably, the directional club of the infrared sensor, which is narrow with respect to the acoustic directional characteristic, extends in the center of the target range of the acoustic directional characteristic. By the term "acoustic directional characteristic" is meant the reception characteristic of a directional microphone. According to this embodiment of the invention, it is more or less conically designed in the functional range wherein the sensitivity increases towards the center of the cone.

BRIEF DESCRIPTION OF THE DRAWINGS

The invention is now discussed in detail by reference to the drawings, in which.

DETAILED DESCRIPTION OF THE INVENTION

Figure 1:
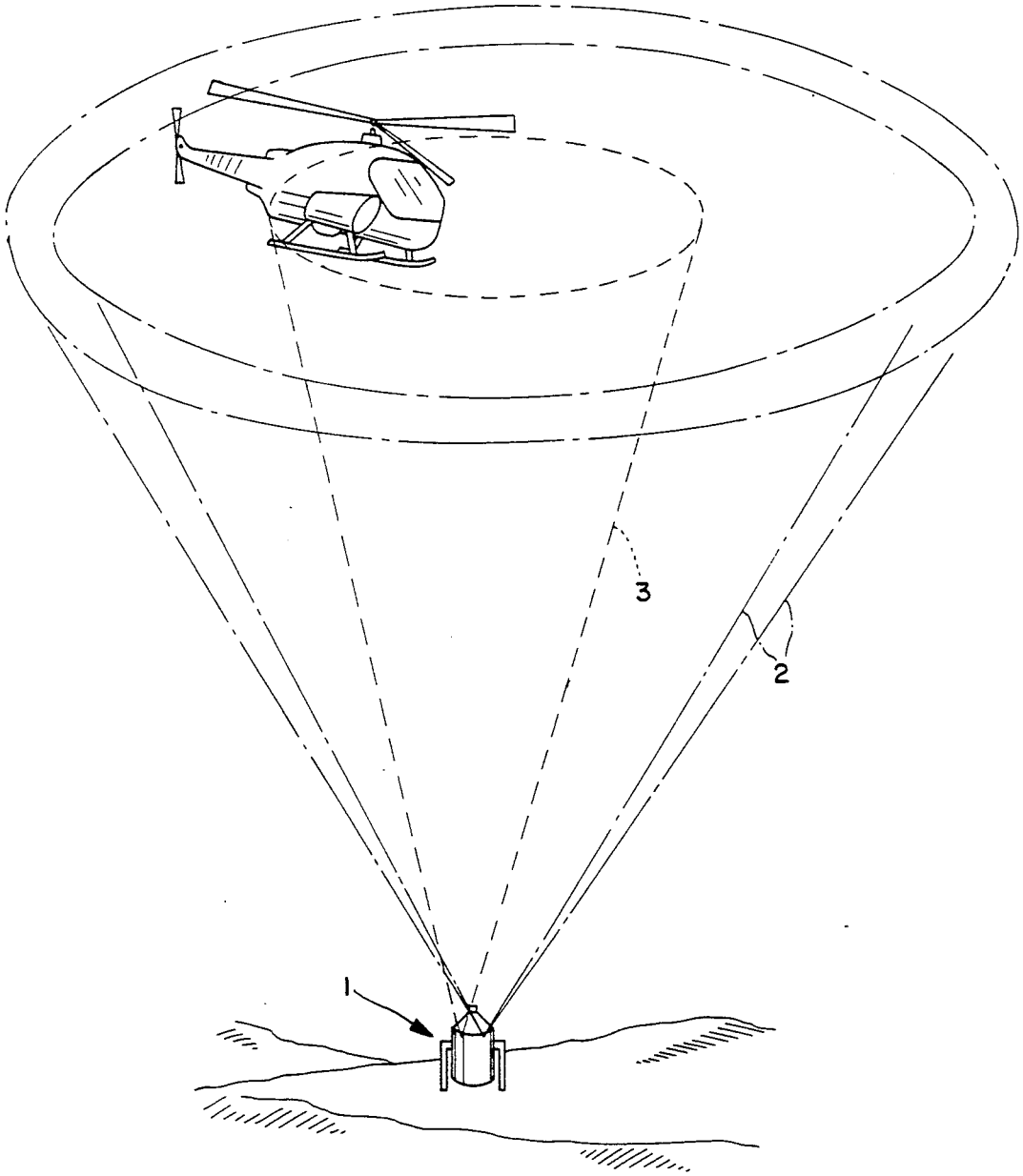
FIG. 1 shows in perspective a ground-to-air mine with an acoustic directional characteristic and a directional club of a first embodiment of the inventive device.

The ground-to-air mine 1 shown in FIG. 1 serves for helicopter combat. It has a directional microphone with a conical acoustic directional characteristic 2. The directional microphone is sensitive to helicopter noise, especially noise in the frequency ranges 5–40 Hz and 200–1000 Hz. In FIG. 1, different cones of the acoustical directional characteristic 2 are shown. Furthermore, the device includes an infrared sensor with a beam-like directional club 3. Due to grounds of scale, the directional microphone and the ground-to-air infrared sensor are not shown in FIG. 1, but they are located on the mine 1 at the vertices of the cones 2 and 3. The ground-to-air mine 1 is adapted to be fired in the direction of the axis of the acoustic directional characteristic 2 and thus also in the direction of the axis of the directional club 3. Furthermore, the ground-to-air mine 1 also includes an electronic evaluation means.

Figure 2:
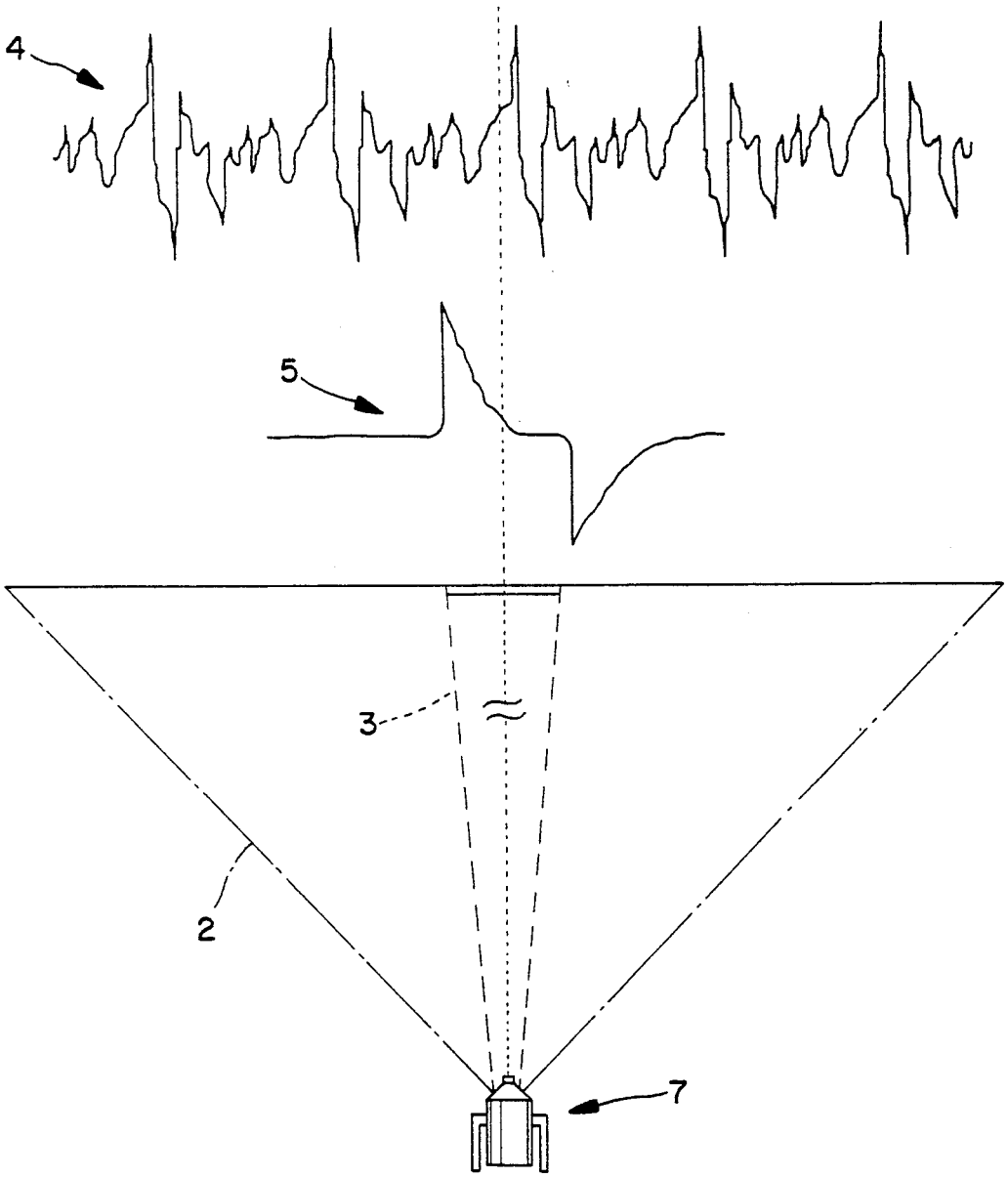
FIG. 2 shows the circumstances under which the device triggers firing of the mine.

In FIG. 2, the helicopter noise shown as signal 4 along a time axis is received by the electronic evaluation means. The infrared signal 5 conveyed from the infrared sensor to the electronic evaluation means is also shown. One can recognize that the directional microphone is directed towards the target range and defines by its acoustic directional characteristic 2 a target area in the center of which the directional club 3, which is narrow with regard to the acoustic directional characteristic 2, extends. The electronic evaluation means analyses the helicopter noise. If a predetermined intensity of helicopter noise is reached, and if the infrared sensor simultaneously reacts, the ground-to-air mine 1 is fired, i.e., the propellant which fires the ground-to-air mine 1 is ignited.

Figure 3:
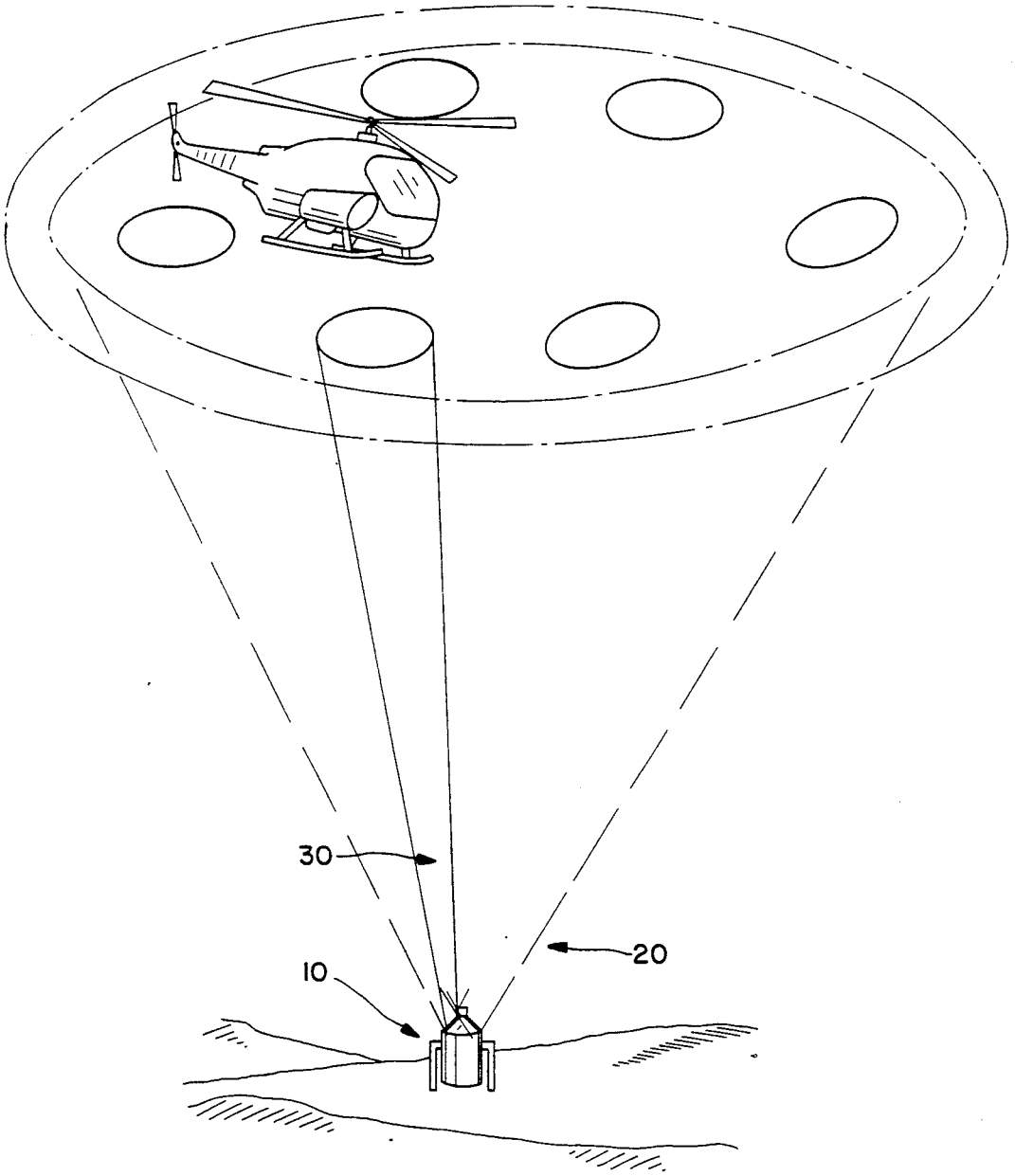
FIG. 3 shows in perspective a ground-to-air mine with an infrared sensor according to a second embodiment of the invention.

FIG. 3 shows a perspective view of a ground-to-air mine 10 similar to that of FIG. 1. According to this example, an especially preferred embodiment of an infrared sensor (not shown) is used. This infrared sensor has a plurality of cones 30 which form zones of maximum sensitivity and which are located within a total active cone 20. Such a sensitivity distribution can be achieved by segmented infrared lenses or mirrors. When the helicopter flies through one of the zones 30, a very significant signal is generated. The gaps between the zones 30 have the effect that the helicopter will not be detected with a certain probability when it passes into the cone 20. This probability increases more and more with increasing distance from the mine. Such a behavior is very much desired since the effectiveness of the mine is limited to a certain distance (for instance, 100 m). Accordingly, a certain protection against false releases by helicopters flying at a height which is too large is attained.

Figure 4:
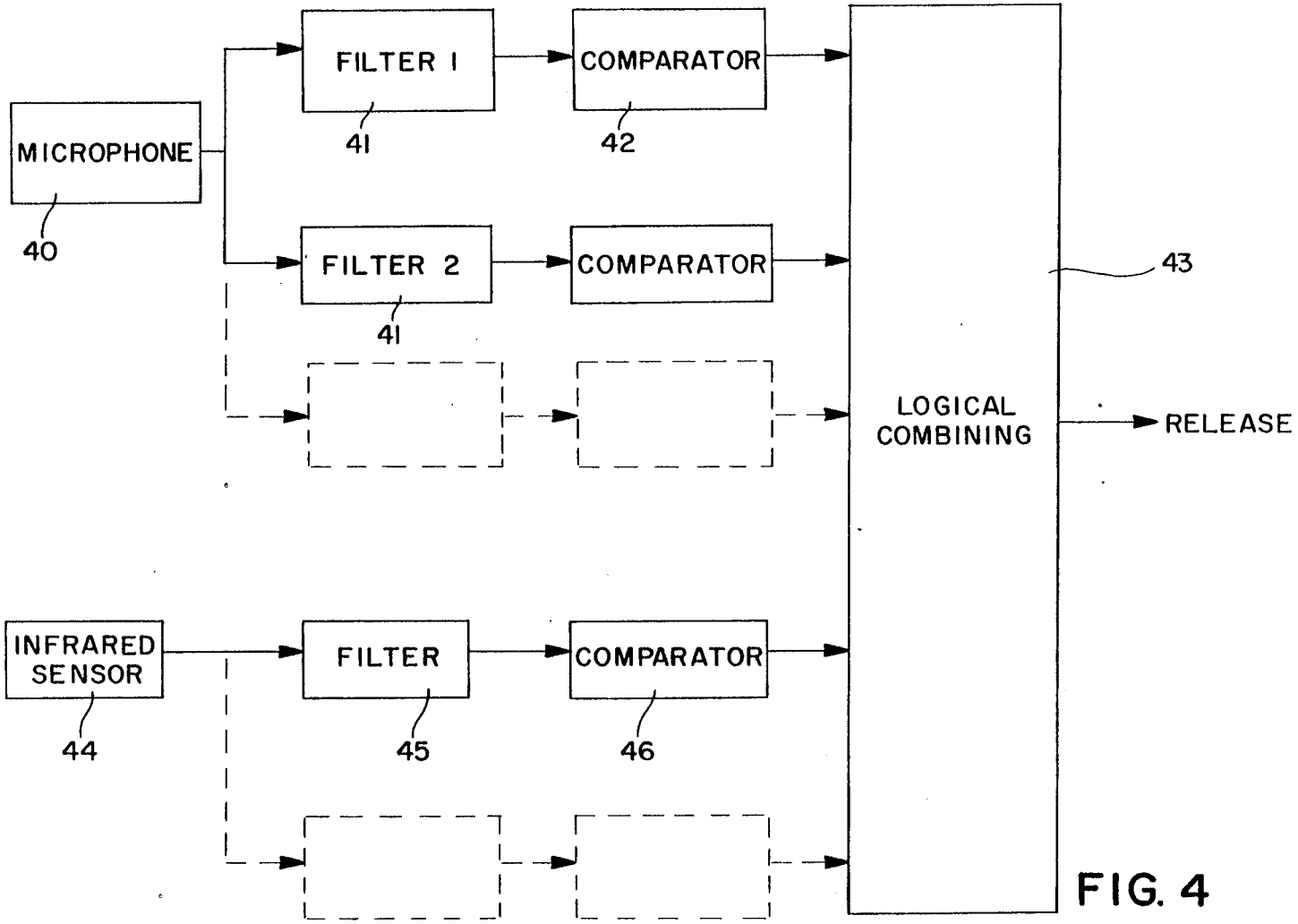
FIG. 4 shows a block diagram of the electronic evaluation means of the inventive device.

FIG. 4 shows a block diagram of the evaluation electronics which is to be used in the embodiments of FIGS. 1 to 3. The evaluation means comprises a microphone 40, which generates electrical signals in response to the helicopter noise. The electrical signals are divided by filters 41,41 into different bands or branches. In this embodiment, two filters are shown; however, further divisions can be made. The divided signals are then separately evaluated and are fed to a logical combining member 43 through respective comparators 42.

Furthermore, FIG. 4 shows an infrared sensor 44. The signals of the infrared sensor are also fed to the logical combining member 43 through a filter 45 and a comparator 46. Here too, a division into a plurality of bands can be made, as indicated by the dotted lines. The logical combining member 43 causes an activation of the ignition means of the mine if signals from the two bands of the microphone and from the infrared sensor are present.

Of course, instead of the described logical combining member, a processor fulfilling this function can be used. Then, the supplied signals are passed through respective A/D convertors.

I claim:

1. A device for detecting flying objects and for causing a ground-to-air mine to be fired at them, said device being suitable for helicopter combat, comprising a microphone which detects noise including noise generated by a helicopter, an infrared sensor having a directional characteristic which is within a firing cone of said ground-to-air mine, and electronic evaluation means for receiving electrical signals generated by said microphone and said infrared sensor, for separating said electrical signals received from said microphone into a first band corresponding to noise having a frequency in the range of 5–40 Hz and a second band corresponding to noise having a frequency in the range of 200–1000 Hz, and for causing said ground-to-air mine to be fired only if electrical signals from said first and second bands and said electrical signals from said infrared sensor are simultaneously present above respective predetermined threshold levels.

2. The device of claim 1 wherein said directional characteristic of said infrared sensor comprises an active cone and a plurality of zones of maximum sensitivity within said active cone.

3. The device of claim 1 wherein said directional characteristic of said infrared sensor comprises a beam-like directional club aligned with a direction of fire of said ground-to-air mine.

4. The device of claim 3 wherein said microphone comprises a directional microphone having a conical acoustic directional characteristic which defines a target area.

5. The device of claim 4 wherein said directional club is narrow relative to said conical acoustic directional characteristic, and wherein said directional club extends in the center of the target area of said conical acoustic directional characteristic.

* * * * *